US006788915B2

(12) United States Patent
Sakamoto

(10) Patent No.: US 6,788,915 B2
(45) Date of Patent: Sep. 7, 2004

(54) IMAGE FORMING APPARATUS OPERABLE IN DUPLEX PRINT MODE WITH HEAT PIPE HELD IN CONTACT WITH INTERMEDIATE IMAGE TRANSFER BODY

(75) Inventor: Kouki Sakamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/214,595

(22) Filed: Aug. 9, 2002

(65) Prior Publication Data

US 2003/0035665 A1 Feb. 20, 2003

(30) Foreign Application Priority Data

Aug. 10, 2001 (JP) ..... 2001-243549

(51) Int. Cl.[7] ..... G03G 15/20
(52) U.S. Cl. ..... 399/309; 399/302
(58) Field of Search ..... 399/92, 94, 302, 399/306, 308, 309, 364; 165/85

(56) References Cited

U.S. PATENT DOCUMENTS 5,337,123 A * 8/1994 Fisher ..... 399/164 X
5,464,200 A 11/1995 Nakazato et al.
5,805,967 A * 9/1998 De Bock et al. ..... 399/299
6,320,642 B1 * 11/2001 Ogawa et al. ..... 399/119
2002/0064404 A1 * 5/2002 Iwai ..... 399/309
2002/0090236 A1 * 7/2002 Omata et al. ..... 399/309

FOREIGN PATENT DOCUMENTS

JP 63-97977 * 4/1988
JP 63097977 A * 4/1988 ..... G03G/15/16
JP 8-44220 2/1996
JP 2825576 9/1998
JP 2001-296755 10/2001

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus operable in a duplex print mode of the present invention includes a heat pipe contacting an intermediate image transfer belt and formed with fins to be cooled off by a fan. A press roller, a plurality of press rollers or a guide plate contacts the inner surface of the intermediate image transfer belt at a position where it faces the heat pipe, increasing the area over which the belt and heat pipe contact each other. This configuration promotes the efficient transfer of heat from the belt to the heat pipe and thereby solves troubles ascribable to heat.

6 Claims, 4 Drawing Sheets

IMAGE FORMING APPARATUS OPERABLE IN DUPLEX PRINT MODE WITH HEAT PIPE HELD IN CONTACT WITH INTERMEDIATE IMAGE TRANSFER BODY

BACKGROUND OF THE INVENTION

1. Field of the Invention

The present invention relates to a copier, printer, facsimile apparatus or similar image forming apparatus operable in a duplex print mode and more particularly to an indirect image transfer type of image forming apparatus including an intermediate image transfer belt.

2. Description of the Background Art

Today, an image forming apparatus operable in a duplex copy mode for printing images on both sides of a sheet is attracting increasing attention from the resource saving standpoint. In such an apparatus, in a duplex copy mode, a color toner image formed on an intermediate image transfer belt is transferred to one side of a sheet by a secondary image transferring device and then fixed on the sheet by a fixing device. Subsequently, an image is formed on the other side of the same sheet and then fixed by the fixing device. If the apparatus is continuously operated in the duplex print mode, then consecutive sheets each carrying an image on one side thereof and heated by the fixing device contact the belt when an image is transferred to the other side. As a result, heat is transferred from the sheets to the belt and raises the temperature of the belt. Because the belt is formed of rubber or similar elastic material and therefore not resistant to heat, it stretches when heated to about 50° C. or above.

The belt heated, in turn, heats a photoconductive drum or image carrier contacting the belt and a belt cleaner also contacting the belt. Further, the drum heated by the belt heats a developing device and a drum cleaner contacting the drum. When the developing device, drum cleaner and belt cleaner are heated to about 50° C., toner blocking occurs.

Japanese Patent Laid-Open Publication No. 2001-92274 proposes an arrangement in which a fan cools off an intermediate image transfer belt or a belt cleaner therefor to thereby prevent toner from melting due to the heat of a fixing device. Japanese Patent Laid-Open Publication No. 2001-27833 discloses an arrangement in which a fan cools off image scanning means for the purpose of preventing the accuracy of the image scanning means from falling due to the heat of a fixing device. However, both of them are directed toward an image forming apparatus operable only in a simplex print mode.

The conventional apparatus operable in a duplex print mode additionally includes a cooling device positioned downstream of the fixing device in the direction of sheet conveyance. The cooling device cools off a sheet carrying an image on one side thereof and coming out of the fixing device. The sheet is cooled off before an image is formed on the other side thereof, thereby coping with the problem stated above. However, repeating heating and cooling is not desirable from the energy saving standpoint.

Technologies relating to the present invention are also disclosed in, e.g., Japanese Patent Laid-Open Publication Nos. 8-44220 and 2001-296755 and Japanese Patent No. 2,825,576.

SUMMARY OF THE INVENTION

It is an object of the present invention to provide an image forming apparatus operable in a duplex print mode and yet capable of reducing the influence of the heat of a fixing device and that of a sheet carrying an image fixed on one side thereof, and saving energy.

An image forming apparatus operable in a duplex print mode of the present invention includes a plurality of image carriers each for forming a particular latent image thereon. A plurality of developing devices each develop the latent image formed on the respective image carrier to thereby produce a corresponding toner images. A primary image transferring device sequentially transfers the toner images formed from the image carriers to an intermediate image transfer body one above the other to thereby complete a composite toner image. A secondary image transferring device transfers the composite toner image from the intermediate image transfer body to a recording medium. A heat pipe is held in contact with the outer periphery of the intermediate image transfer body and includes fins, which are cooled off by a fan. A press roller is held in contact with the inner periphery of the intermediate image transfer body at a position where it faces the heat pipe.

The press roller may be replaced with a plurality of press rollers in order to increase the area over which the heat pipe and intermediate image transfer body contact each other. Further, the plurality of press rollers may be replaced with a guide plate for the same purpose.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
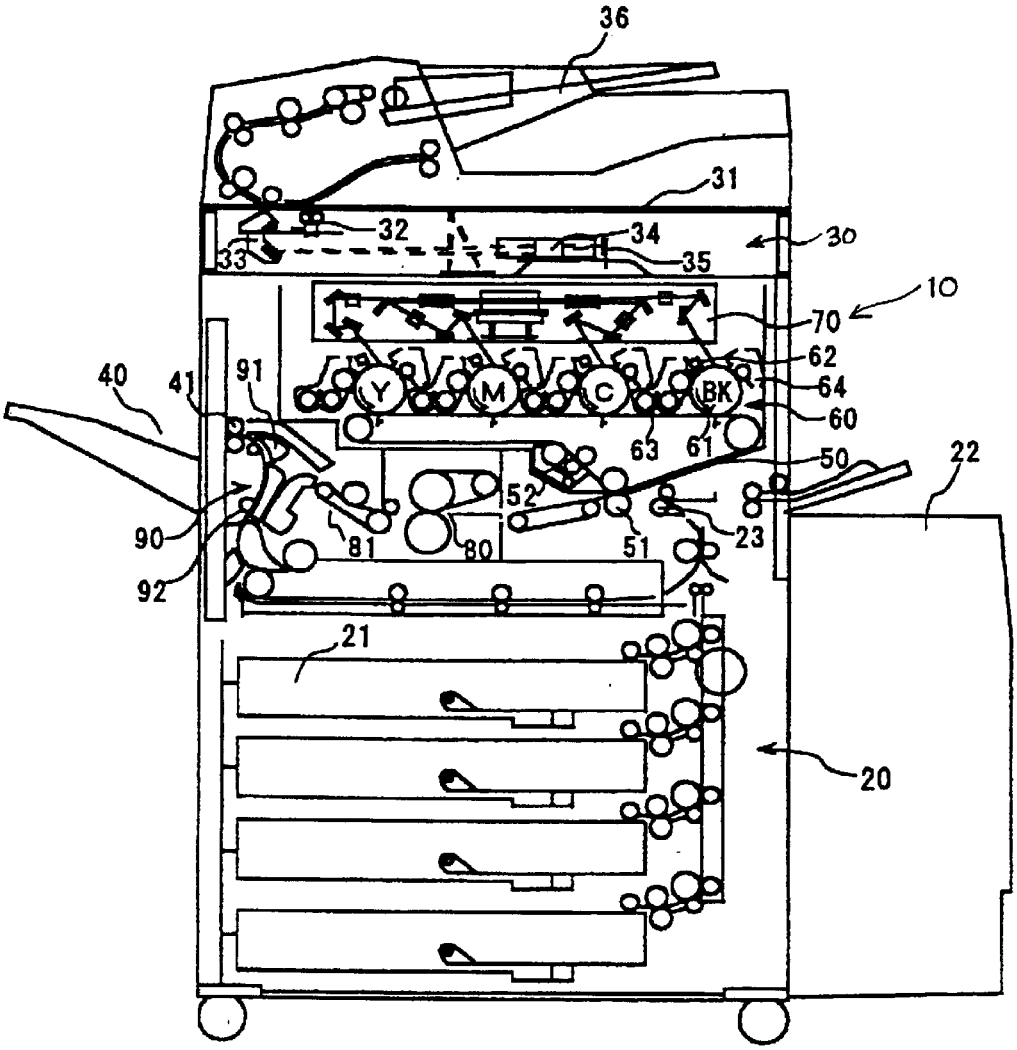
FIG. 1 PRIOR ART
FIG. 1 is a view showing a conventional image forming apparatus operable in a duplex print mode.

To better understand the present invention, brief reference will be made to a conventional image forming apparatus operable in a duplex print mode, shown in FIG. 1. As shown, the image forming apparatus includes an intermediate image transfer belt (simply belt hereinafter) 50, which is a specific form of an intermediate image transfer body. In a simplex print mode, a color toner image formed on the belt 50 is transferred to a sheet by a secondary image transferring device 51 and then fixed on the sheet by a fixing device 80. The sheet with the fixed image, i.e., a print is driven out of the apparatus to a print tray 40.

In a duplex print mode, an image is formed on the other side of the sheet carrying the fixed image on one side thereof and is then fixed on the sheet by the fixing device 80. The resulting duplex print is also driven out to the print tray 40. If the apparatus is continuously operated in the duplex print mode, then consecutive sheets each carrying an image on one side thereof and heated by the fixing device 80 contact the belt 50 when an image is transferred to the other side. As a result, heat is transferred from the sheets to the belt 50 and raises the temperature of the belt 50. The belt 50, in turn, heats photoconductive drums or image carriers 61 contacting the belt 50 and a belt cleaner 52 also contacting the belt 50. Further, each drum 61 heated by the belt 50 heats a developing device 63 and a drum cleaner 64 contacting the drum 61. When the developing device 63, drum cleaner 64 and belt cleaner 52 are heated to about 50° C., toner blocking occurs, as stated earlier.

The apparatus additionally includes a cooling device 81 positioned downstream of the fixing device 80 in the direction of sheet conveyance. The cooling device 81 cools off a sheet carrying an image on one side thereof and coming out of the fixing device 80. The sheet is cooled off before an image is formed on the other side thereof, thereby coping with the problem stated above. However, repeating heating and cooling is not desirable from the energy saving standpoint.

Figure 2:
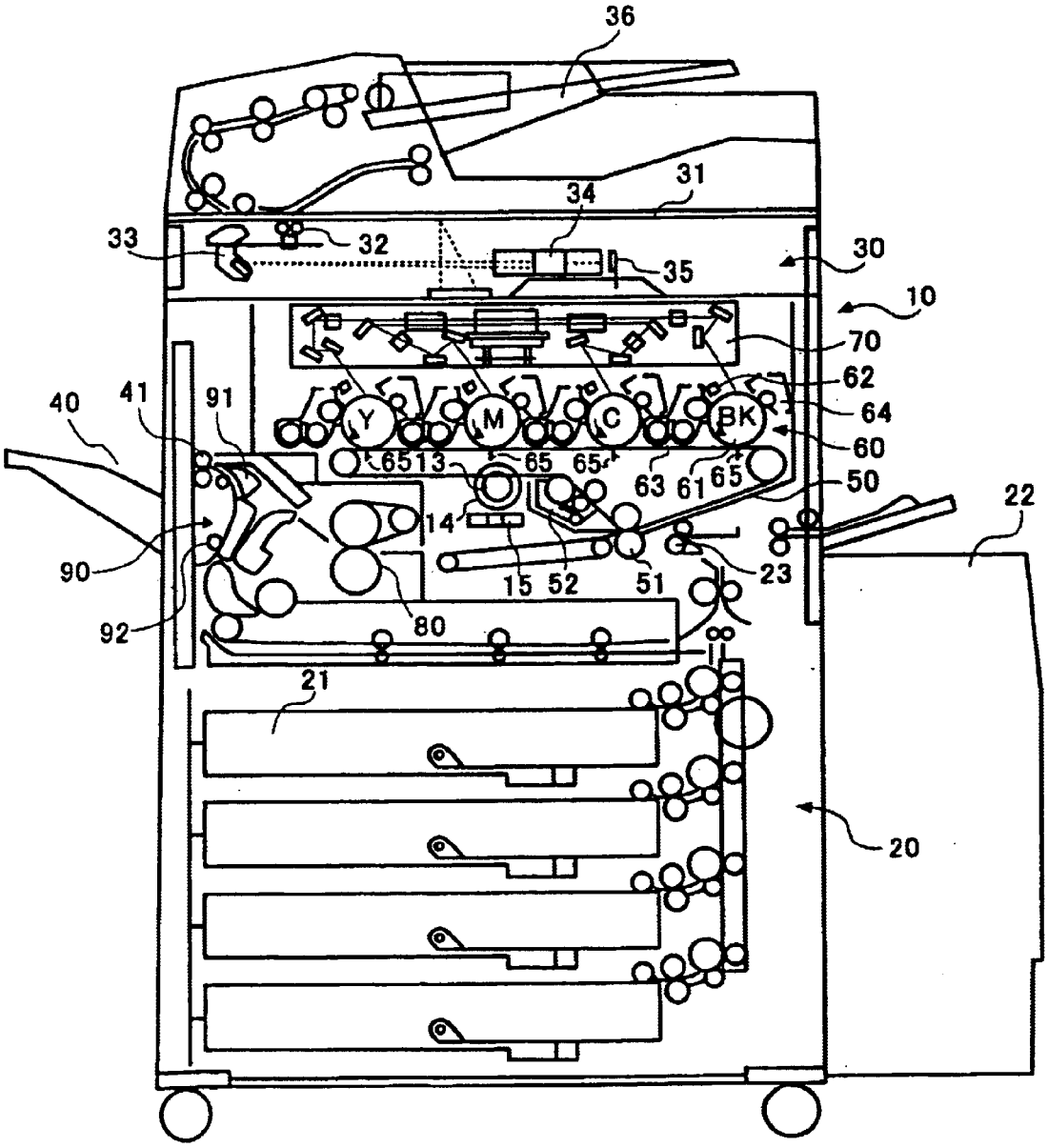
FIG. 2 is a view similar to FIG. 1, showing an image forming apparatus embodying the present invention and operable in a duplex print mode.

Referring to FIG. 2, a color image forming apparatus embodying the present invention is shown. As shown, an image forming section, generally 10, is arranged at substantially the center of the apparatus. A sheet feeding section 20 is positioned beneath the image forming section 10 and includes a plurality of sheet cassettes 21. An additional sheet feeder 22 may be connected to the apparatus, as needed. An image scanning section 30 is positioned above the image forming section 10 for scanning a document. A print tray 40 is mounted on the apparatus at the left-hand side of the image forming section 10, as viewed in FIG. 2.

The image forming section 10 includes a primary image transferring device 65, an intermediate image transfer belt (simply belt hereinafter) 50 and a plurality of image forming stations 60 arranged side by side along the belt 50. Each image forming station 60 is assigned to one of yellow (Y), magenta (M), cyan (C) and black (BK) and includes a photoconductive drum or image carrier 61. Arranged around the drum 61 are a charger 62, a developing device 63, and a drum cleaner 64. The charger 62 uniformly charges the surface of the drum 61. An optical writing unit 70 scans the charged surface of the drum 61 with a laser beam in accordance with image data, thereby forming a latent image on the drum 61. The developing device 63 develops the latent image with toner to thereby form a corresponding toner image. The drum cleaner 64 removes toner left on the drum 61 after image transfer.

While the belt 50 is in movement, toner images of different colors are sequentially transferred from the drums 61 to the belt 50 one above the other to thereby complete a full-color image (primary image transfer). More specifically, a yellow toner image is first transferred to the belt 50 at the Y image forming station 60. Subsequently, a magenta toner image is transferred to the belt 50 over the yellow toner image at the M image forming station 60. Likewise, a cyan toner image is transferred to the belt 50 over the composite, yellow and magenta toner image at the C image forming station 60. Finally, a black toner image is transferred to the belt 50 over the composite, yellow, magenta and cyan toner image at the BK image forming station 60, completing a full-color image.

A secondary image transferring device 51 and a belt cleaner 52 are also arranged around the belt 50. The secondary image transferring device 51 transfers the full-color image from the belt 50 to a sheet or recording medium. The belt cleaner 52 removes toner left on the belt 50 after image transfer.

A fixing device 80 is positioned downstream of the secondary image transferring device 51 in the direction of sheet conveyance in order to fix the toner image on the sheet. The sheet with the fixed toner image, i.e., a print coming out of the fixing device 80 is driven out to the print tray 40 by an outlet roller pair 41.

In a duplex print mode, a path selector 91 steers the sheet carrying the toner image on one side thereof into a duplex printing unit 90. The duplex printing unit 90 turns the sheet and then drives it toward a registration roller pair 23. The registration roller pair 23 again conveys the sheet to the image forming section 10 while correcting the screw of the sheet.

More specifically, the sheet cassettes 21 of the sheet feeding section 20 each are loaded with a stack of fresh sheets. In each sheet cassette 21, an angularly movable bottom plate raises the sheet stack to a position where a pickup roller can contact the top of the sheet stack. When the pickup roller is rotated, it pays out the top sheet from the sheet cassette 21 toward the registration roller pair 23. The registration roller pair 23 once stops the sheet and then conveys it toward the image forming section 10 such that the leading edge of the sheet meets the leading edge of a toner image formed on the drum 61.

The image scanning section 30 includes two carriages 32 and 33 including a light source and a mirror. While the carriages 32 and 33 are in movement, the light source scans a document. The resulting reflection from the document is incident to a CCD (Charge Coupled Device) image sensor 35 via the mirror and a lens 34. An image signal output from the image sensor 35 and representative of the document image is digitized and then processed in a conventional manner. A laser diode, not shown, included in the optical writing unit 70 emits a laser beam in accordance with the processed image signal. The laser beam scans the surface of the drum 61 via a polygonal mirror and a lens for thereby forming a latent image thereon. An ADF (Automatic Document Feeder) 36 is positioned above the image scanning section 30 in order to automatically feed a document to a glass platen.

The illustrative embodiment is operable as a digital color copier that scans a document, digitizes the resulting image signal, and then forms an image on a sheet, as stated above. In addition, the illustrative embodiment has a facsimile function for interchanging image data with a remote station via a controller, not shown, and a printer function for printing image data received from a computer on a sheet. Sheets carrying images implemented by all of such functions are driven out to a single print tray 40.

Assume that prints are sequentially steered by the path selector 91 into the duplex printing unit 90, turned thereby, and then driven out via a turn roller 92 and the outlet roller pair 41. Then, such prints are sequentially stacked on the print try 40 with their image surfaces facing downward. Therefore, even when documents are scanned from the first page, the first page is positioned at the top of the prints when removed by the print tray 40 by hand. This frees the operator of the apparatus from troublesome work otherwise needed to, e.g., rearrange the pages of the prints.

In the illustrative embodiment, a heat pipe 13 is held in contact with the belt 50 and provided with fins 14 at its rear end portion, as seen in a direction perpendicular to the sheet surface of FIG. 2. A fan 15 cools off the fins 14. The heat pipe 13 is positioned downstream of the belt cleaner 52 in the direction in which the belt 50 moves. The heat pipe 13 is a sealed vacuum pipe formed of aluminum, copper or similar metal and filled with pure water or similar operating fluid. When the fluid is heated, it moves to the end of the heat pipe 13 in the form of steam. The steam again changes to the fluid when radiated heat to the outside. The fluid repeats such an operation in a moment. In this manner, the illustrative embodiment does not directly cool off a sheet, but operates in such a manner as to reduce the temperature drop of a sheet. This successfully reduces energy consumption when an image is fixed on the other side of a sheet.

Figure 3:
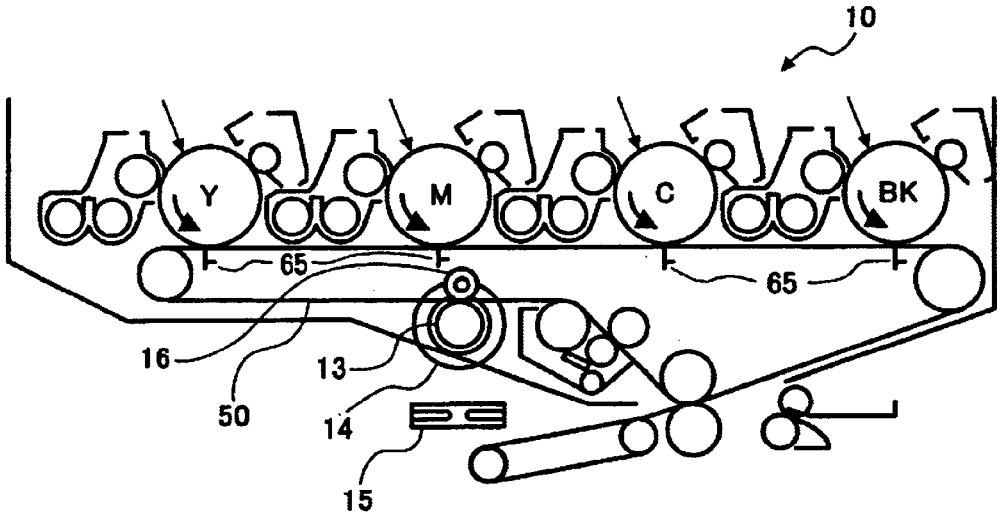
FIGS. 3 through 5 are fragmentary enlarged views each showing a particular modification of the illustrative embodiment.

As shown in FIG. 3, a press roller 16 contacts the inner surface of the belt 50 at a position where it faces the heat pipe 13. The press roller 16 presses the belt 50 against the heat pipe 13 for thereby promoting the efficient transfer of heat (oscillation of molecules) from the belt 50 to the heat pipe 13. The press roller 16 is formed of EPDM or similar elastic rubber. The press roller 16 should preferably have an axial length greater than the width of the belt 50 and have a diameter about one-half of the diameter of the heat pipe 13 or below.

Figure 4:
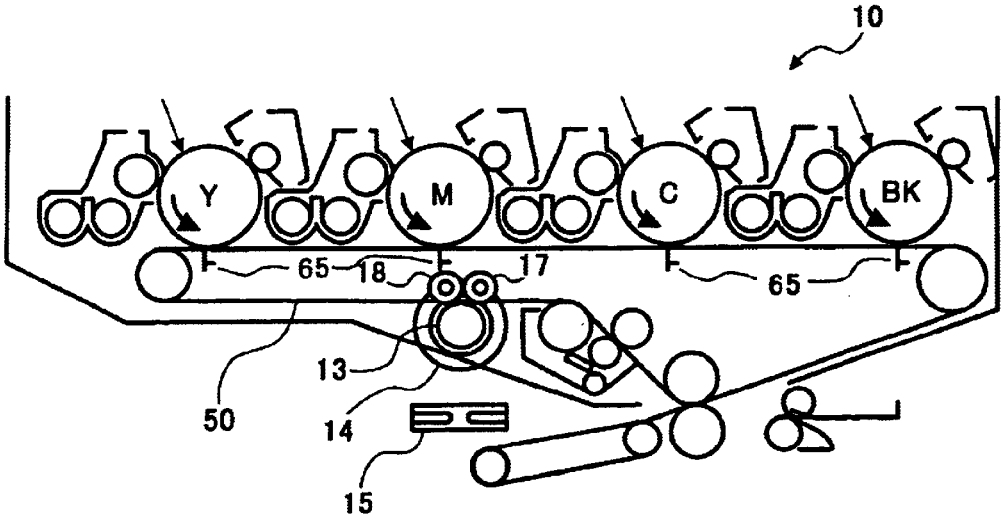

FIG. 4 shows a modification of the illustrative embodiment. As shown, a plurality of press rollers 17 and 18 are substituted for the press roller 16 of FIG. 3. This configuration increases the area over which the belt 50 and heat pipe 13 contact each other and therefore the duration of contact, thereby further promoting the efficient heat transfer from the belt 50 to the heat pipe 13. In addition, the efficient heat transfer is achievable even when the pressure of the press rollers 17 and 18 to act on the belt 50 is low, promoting energy saving.

Figure 5:
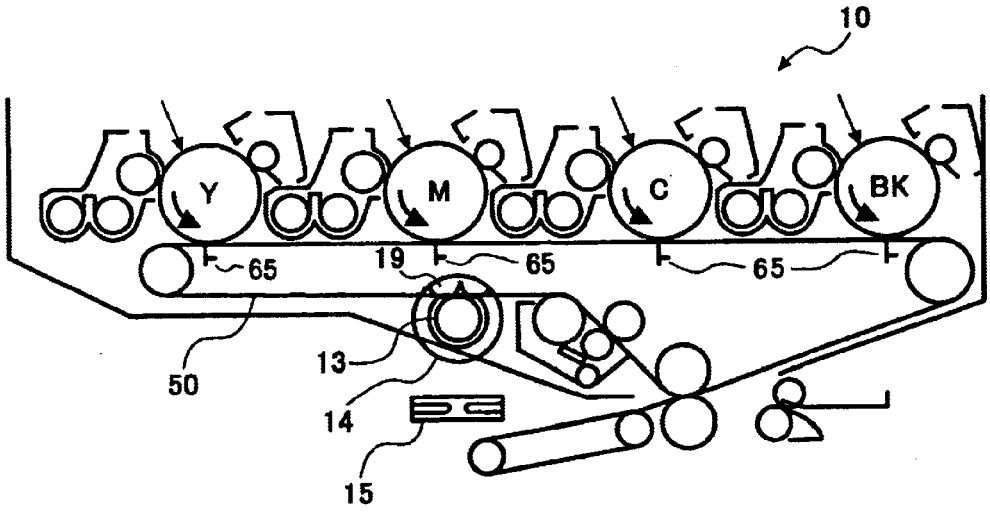

FIG. 5 shows another modification of the illustrative embodiment. As shown, a guide plate 19 is substituted for the press rollers 17 and 18, FIG. 4, and contacts the inner surface of the belt 50 while facing the heat pipe 13. The guide plate 19 is configured to increase the area over which the belt 50 and heat pipe 13 contact each other, thereby promoting the efficient heat transfer from the belt 50 to the heat pipe 13 like the press rollers 17 and 18. In addition, the guide plate 19 is low cost. To reduce resistance to act between the belt 50 and the guide member 19, the guide member 19 is implemented as an extrusion of aluminum coated with, e.g., Teflon. It should be noted that the configuration of the guide member 19 shown in FIG. 5 is only illustrative. The crux is that the guide member 19 allows the belt 50 to easily wrap around the heat pipe 13.

Experiments were conducted with the image forming apparatus shown in FIG. 3. When the heat pipe 13 had a diameter of 30 mm and when the heat roller 16 exerted pressure of 200 g to 300 g at one side, the heat pipe 13 and belt 50 contacted each other over a width of about 3 mm. Such a contact width prevented the temperature of the belt 50 from rising.

On the other hand, when two press rollers were used and each exerted pressure of 150 g to 200 g at one side, the heat pipe 13 and belt 50 contacted each other over a width of about 26 mm. In this condition, the temperature of the belt 50 was more effectively prevented from rising.

In summary, it will be seen that the present invention provides an image forming apparatus capable of efficiently transferring the heat of an intermediate image transfer belt to a heat pipe at low cost. The apparatus of the present invention can therefore solve the problem ascribable to heat generated in a fixing device.

What is claimed is:

1. An image forming apparatus operable in a duplex print mode, comprising:

a plurality of image carriers each for forming a particular latent image thereon;

a plurality of developing devices each for developing the latent image formed on a respective image carrier to thereby produce a corresponding toner images;

an intermediate image transfer body;

a primary image transferring device for sequentially transferring toner images formed on said plurality of image carriers to said intermediate image transfer body one above the other to thereby complete a composite toner image;

a secondary image transferring device for transferring the composite toner image from said intermediate image transfer body to a recording medium;

a heat pipe held in contact with an outer periphery of said intermediate image transfer body and at least one fin positioned on an outer periphery portion of the heated pipe;

a fan positioned to cool off said at least one fin; and a press roller held in contact with an inner periphery of said intermediate image transfer body at a position where said press roller faces said heat pipe.

2. An image forming apparatus operable in a duplex print mode, comprising:

a plurality of image carriers each for forming a particular latent image thereon;

a plurality of developing devices each for developing the latent image formed on a respective image carrier to thereby produce a corresponding toner images;

an intermediate image transfer body;

a primary image transferring device for sequentially transferring toner images formed on said plurality of image carriers to said intermediate image transfer body one above the other to thereby complete a composite toner image;

a secondary image transferring device for transferring the composite toner image from said intermediate image transfer body to a recording medium;

a heat pipe held in contact with an outer periphery of said intermediate image transfer body and at least one fin positioned on an outer periphery portion of the heated pipe;

a fan positioned to cool off said at least one fin; and a plurality of press rollers held in contact with an inner periphery of said intermediate image transfer body at a position where said plurality of press rollers face said heat pipe, whereby an area over which said heat pipe and said intermediate image transfer body contact each other is increased.

3. An image forming apparatus operable in a duplex print mode, comprising:

a plurality of image carriers each for forming a particular latent image thereon;

a plurality of developing devices each for developing the latent image formed on a respective image carrier to thereby produce a corresponding toner images;

an intermediate image transfer body;

a primary image transferring device for sequentially transferring toner images formed on said plurality of image carriers to said intermediate image transfer body one above the other to thereby complete a composite toner image;

a secondary image transferring device for transferring the composite toner image from said intermediate image transfer body to a recording medium;

a heat pipe held in contact with an outer periphery of said intermediate image transfer body and at least one fin positioned on an outer periphery portion of the heated pipe;

a fan positioned to cool off said at least one fin; and a guide plate held in contact with an inner periphery of said intermediate image transfer body at a position where said guide plate faces said heat pipe.

4. An image forming apparatus according to claim 1, wherein the at least one fin is positioned around the heat pipe and parallel to a moving direction of the intermediate image transfer body.

5. An image forming apparatus according to claim 2, wherein the at least one fin is positioned around the heat pipe and parallel to a moving direction of the intermediate image transfer body.

6. An image forming apparatus according to claim 3, wherein the at least one fin is positioned around the heat pipe and parallel to a moving direction of the intermediate image transfer body.

* * * * *